United States Patent [19]

Vogelsberg

[11] 4,056,925

[45] Nov. 8, 1977

[54] METHOD AND APPARATUS FOR THE SZ-TWISTING OF ELECTRICAL CABLES

[75] Inventor: Dieter Vogelsberg, Berlin, Germany

[73] Assignee: Siemens Aktiengesellschaft, Munich, Germany

[21] Appl. No.: 630,947

[22] Filed: Nov. 12, 1975

[30] Foreign Application Priority Data

Nov. 15, 1974 Germany ..... 2454777

[51] Int. Cl.[2] ..... D01H 7/90; H01B 13/02

[52] U.S. Cl. ..... 57/34 AT; 57/156

[58] Field of Search ..... 57/34 AT, 156

[56] References Cited

U.S. PATENT DOCUMENTS

| | | | |
|---|---|---|---|
| 2,957,302 | 10/1960 | Lenk et al. | 57/34 AT |
| 2,981,049 | 4/1961 | Crosby et al. | 57/34 AT |
| 3,017,450 | 1/1962 | Crosby et al. | 57/34 AT |
| 3,460,334 | 8/1969 | Lawrenson et al. | 57/34 AT X |
| 3,491,525 | 1/1970 | Sugi | 57/34 AT |
| 3,572,024 | 3/1971 | Lyons | 57/34 AT X |
| 3,593,509 | 7/1971 | Feese et al. | 57/34 AT |
| 3,631,662 | 1/1972 | Bienfait | 57/34 AT X |
| 3,941,166 | 3/1976 | Maillefer | 57/34 AT X |

FOREIGN PATENT DOCUMENTS

| | | | |
|---|---|---|---|
| 2,140,697 | 2/1972 | Germany | 57/34 AT |

*Primary Examiner*—Jerry W. Myracle
*Assistant Examiner*—Charles Gorenstein
*Attorney, Agent, or Firm*—Kenyon & Kenyon, Reilly, Carr & Chapin

[57] ABSTRACT

A twisting disk disposed within a torsioning section between two twisting points in the vicinity of the exit point of the torsioning section and which rotates with a direction of rotation alternating by sections in used to avoid over twisting of the twisting elements during the SZ-twisting of electrical cables.

17 Claims, 13 Drawing Figures

METHOD AND APPARATUS FOR THE SZ-TWISTING OF ELECTRICAL CABLES

BACKGROUND OF THE INVENTION

This invention relates to the productions of electrical cables in general and more particularly to an improved method and apparatus for SZ-twisting electrical cables.

Various methods and apparatus have been developed recently which can be used for twisting elements with a twist direction which changes from section to section. This type of twisting which is widely used in twisting electrical cables is known as SZ-twisting. Such a technique has the advantage that the twisting elements run off from stationary frames or supply containers and can be wound on take-up drums also arranged in a stationary manner. This permits performing several operations in series which were previously performed separately. For example, the insulating of conductors and subsequent twisting or several consecutive twisting stages of the twisting elements and the subsequent spraying of the sheath can be accomplished in the same operation. The origin of the SZ-twisting technique was a method in which conductors of communications cables running from stationary reels were twisted by means of a perforated or twisting disk arranged ahead of a twisting nipple the disk executing an oscillating motion relative to the twisting axis. In such a device or method the twisting elements run directly from the conductor supplies through the twisting disk into the twisting nipple. In an arrangement of such nature, the twisting disk can execute only one or at most two revolutions in one direction. (See, for example, German Patent No. 610,650). This known twisting apparatus has not been found acceptable in practice for twisting conductors for use in communications cables because the twisting lays obtainable in one direction are too small. In order to carry-out as the twisting of conductors for electrical cables, methods and apparatus have been developed permitting the twisting elements to be twisted with the same twist direction over a longer section and then subsequently twisted with an opposite direction for an equivalent distance. For example, twisting in one direction over lengths of 5 to 20 meters with the minimum length of lay of about 10 meters is needed. One method which is suited for this purpose causes the elements to be first fed to a first fixed point for forming into a twisted unit. The twisted unit formed from the twisting elements remains in a stretched, torsionable condition between the first fixed point and the second fixed point. It is then twisted in a section-wise manner by a multiple of twisting lays using a twisting device which engages the twisted unit perpendicularly to its axis with positive force transmission. It is quite important that the twisting device be arranged closer to the second fixed point than to the first fixed point and that the rotary motion of the twisting device is changed at intervals which are smaller than three times the time for the passages of a cross-section element of the twisted element through the torsioning section defined by the first and the second fixed points. A device of this nature is disclosed in U.S. Pat. No. 3,593,509. In order to operate such a twisting apparatus with maximum efficiency, it is advisable that the twisting device changes its direction of rotation at intervals. In the process, however, an overtwisting of the twisting elements can occur between the first fixed point and the twisting device. This has an adverse effect on the electrical coupling of the twisted unit, particularly when twisting of conductors to form a unit such as a spiral quad.

In order to prevent overtwisting of conductors which may result in the SZ-twisting of conductors to form spiral quads, a method has been developed in which several twist reversal devices in the form of a perforated rotating disk, by means of which an already twisted material is temporarily untwisted and twisted again, have been used. This type of arrangement has been used in SZ-twisting devices in which a constant length of lay is imparted to the material being twisted within a section with the same twist direction. The perforated disk has a twisting nipple associated with it on both sides and is located behind the respective twisting device and rotates with a speed and direction of rotation which is a function of the length of lay of the twist material in each case, the twist direction and the pull-off velocity. Such is disclosed in British Patent No. 1,144,791.

Another method of avoiding overtwisting comprises providing a torsioning section defined by two twisting points in which, immediately behind the first twisting point, a revolving twisting head is arranged. A similarly revolving twisting head is placed immediately ahead of the second twisting point. The twisting heads always revolve with the same and a constant direction of rotation. Such is disclosed U.S. Pat. No. 3,823,536.

Although these various devices work well for different purposes they do have certain deficiencies. In view of this it is the object of the present invention to provide a SZ-twisting method and apparatus for twisting elements of electric cables at a high production speeds while still permitting an exact twisting of the twisting elements even in the vicinity of the reversal points of the twist direction.

SUMMARY OF THE INVENTION

In order to solve this problem, the invention starts out with an apparatus for the twisting of elements for electric cables to form a twisted unit having a twist direction changing section by section and consisting of a supply device for the twisting elements, the twisting apparatus itself, a pulling-off means and a winding device following that means. In this apparatus the twisting device itself comprises a torsioning section defined by two twisting points, or, where parallel operation is to be used, has parallel torsioning sections defined by two twisting points in each case. Within each torsioning section a twisting device which is adapted to be driven for rotation in either direction is placed closer to the second twisting point than to the first twisting point. In accordance with the present invention the twisting device comprises a twisting disk. To twist the elements using such a twisting device it is further provided that the twisting elements run through the torsioning section in a stretched condition and that the direction of rotation of the twisting device containing the twisting disk is changed after at least three revolutions in one direction.

The present invention is based on the insight that, when twisting with alternating direction of twist using a twisting disk, a multiplicity of revolutions of the twisting disk in the same direction can be obtained without adverse mechanical effects on the twisting elements resulting in larger sections of the same direction of twist, if steps are taken to ensure that the twisting exerted in the backward direction by the twisting disk is distributed over a fairly long section. In accordance with this principle a torsioning section which is terminated in the backward direction by the first twisting point and in which the material to be twisted is disposed in stretched condition is provided ahead of the twisting disk. The length of this torsioning section depends on the respective, chosen length of lay of the material to be twisted and is at least three times this length of lay, and preferably more than ten times the length of lay. Within the torsioning section, the material, depending on the twist direction of the twisting disk, is continually twisted. The length of lay of the twisted material increases and decreases linearly in an alternatingly manner within this zone. In the vicinity of the twisting disk itself the twisted material is untwisted and, immediately thereafter, the final twisting of the twisting elements is accomplished. An unambiguous mutual correlation of the twisting elements even in the vicinity of the reversal points of direction of rotation of the twisting disk is ensured through the use of the twisting disk and thus takes place at the point where the twist direction in the twisted material changes. Due to the fact that the material to be twisted is conducted through the twisting apparatus in a stretched condition and the twisting disk revolves with a direction of rotation which alternates, maximum efficiency is achieved with a given maximum speed of rotation of the twisting machine and in consideration of the desired respective length of lay and the pulling-off velocity of the material to be twisted given thereby.

It was noted above that it is essential in the method of the present invention that the twisting of the elements in the backward direction caused by the twisting disk be distributed over a fairly long section. In order to accomplish homogeneous twisting of the material, it is advantageous to arrange a twisting nipple immediately in front of the twisting device on its side toward the first twisting point. The development of a homogeneous twist of the material to be twisted is furthermore promoted if this twisting nipple is arranged rotatably and, for example, is firmly coupled mechanically to the twisting disk.

Furthermore, it is advisable to have a twisting nipple associated with the twisting disk on the other side. This nipple may also be arranged for rotation, for example, it may be solidly mechanically coupled to the twisting disk. Such a twisting nipple has a favorable effect on the exact, permanent twisting of the elements behind the twisting disk.

To develop a homogeneous twist of the material between the first twisting point and the twisting disk, if may also be advantageous to arrange one or more further twisting devices in this region. These will be devices which grab the material to be twisted from the outside in the manner of a friction clutch in the circumferential direction with a light force. Their direction of rotation is coupled to the direction of rotation of the twisting device containing the twisting disk. These further twisting devices may comprise, in the simplest case, rotatable twisting nipples or may also be rotatable guide tube sections. In place of a plurality of further twisting devices, a single guide tube for the material to be twisted may be provided. Such a tube will be connected to the twisting device containing the twisting disk and extending from the twisting device in the direction toward the first twisting point. Advantageously its length will be about one-third to one-half of the distance between the twisting device containing the disk and the first twisting point.

The twisting of the elements using the described apparatus, in which twisting of the elements is accomplished solely by means of a twisting device containing a twisting disk, or in co-operation with further twisting devices promoting a homogeneous twisting of the elements, is preferably is carried out such that the direction of rotation of the twisting device containing the disk is changed at intervals corresponding to twice the passage time of a cross-section element of the strand from the first twisting point to the twisting disk. In such case it will be assured that the twisted material will not have shorter lengths of lay in the region of the torsioning section or sections than in the finished condition. As a result there will be no excessive mechanical stress of the twisted materials in the region of the torsioning section or sections.

The speeds of rotation of the further twisting devices which may be provided for developing a homogeneous twist can be chosen to increase in the direction toward the twisting disk. That is to say, such a speed may be proportional to the distance of the particular device from the first twisting point. Such an arrangement has favorable effects on the mechanical stresses placed on the twisted material during twist reversal by means of the twisting disk.

In one particular advantageous embodiment of the new twisting apparatus, the twisting device containing the twisting disk is arranged immediately ahead of the second twisting point. In addition a second twisting device which grabs the twisting elements together from outside with a positive force is placed immediately behind the first twisting point. In order to twist elements using such a twisting device it is advisable that the device containing the disk revolve with alternating directions of rotation and that it always revolve with the same speed of rotation. Furthermore, it is advisable that the additional twisting device always rotate in the same direction but at only one-half the speed of rotation of the twisting disk. In connection with this embodiment is additionally important that the direction of rotation of the twisting device with the disk and of the additional twisting device be changed at intervals corresponding to the time of passage of a cross-sectional element between the first twisting point and the twisting disk. With such an arrangement, the torsioning process itself take place essentially only between the first twisting point and the additional twisting device in an exactly defined manner. In addition, the twisted material always has a constant length of lay in the region between the additional twisting device and the twisting device with the twisting disk, except for reversal points of the twist direction which are running through that section. As a result, no torsioning of the twisted material takes place in this region. This in turn results in a section of twisted material having a length of lay and direction of lay always synchronized with the rotary motion of the twisting disk being fed to the twisting disk. The end result is the passage of the individual twisting elements of the twisted material through the twisting disk in such a manner that there is a minimum of mechanical stress on the twisted material.

As noted above, the twisting disk of the present invention executes a plurality of revolutions alternating in one direction and the other. If the additional twisting device just described and placed immediately behind the first twisting point is used it is advisable that the distance between this additional twisting device and the device containing the disk be a multiple of the length of lay generated in the twisting apparatus. In particular it should be 10 to 50 times the length of lay. In order to avoid an untwisting of the reversal points of twist direction in the region between the additional twisting device and the device containing the disk, which can develop as a consequence of the changing direction of rotation of the additional twisting device in the vicinity of the first twisting point, in accordance with a further feature of the present invention, it is advantageous to arrange one or more elements for guiding the twisted material under the action of frictional force transmission in the region between the additional twisting device and the device containing the disk. Typically such a guiding element may be a caterpillar band rotating about the twisting axis with the twisted material resting against the band on one side. A bar rotating about the twisting axis and having a longitudinal slot for guiding the twisting material can also be used. Alternatively, twisting devices, coupled to the additional twisting device, which grab the twisted material from the outside with frictional force transmission may also be provided and used in this case used as elements for guiding the twisted material. In any case, where such elements are used for guidance they will advantageously revolve synchronously with the additional twisting device.

BRIEF DESCRIPTION OF THE DRAWINGS p

FIGS. 1 through 8 and 10 through 13 are schematic block diagrams of various alternate embodiments of twisting arrangements according to the present invention.

FIG. 9 is a more detailed drawing of one specific embodiment of the present invention shown in side-view.

DETAILED DESCRIPTION OF THE PREFERRED EMBODIMENT

Figure 1:
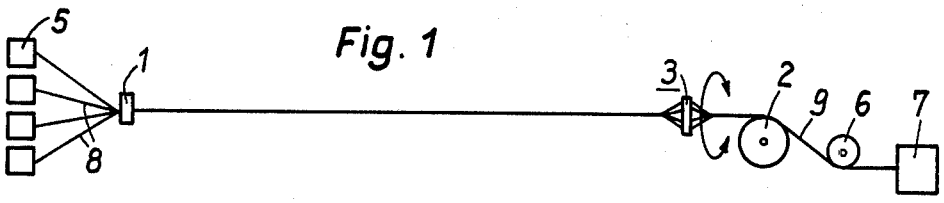

FIG. 1 illustrates a twisting apparatus in which a plurality of elements 8 are twisted to form a twisted finished unit 9 e.g., a spiral quad, in accordance with the present invention. To carry out such twisting a torsioning section is used with the torsioning section formed between a guide nipple 1 and a deflection roller 2. The nipple 1 is the first twisting point in the deflection roller 2 the second twisting point within this torsioning section. In this section the elements will be maintained in a tensioned i.e., stretched, condition. A twisting device 3 is arranged coaxially with the twisting nipple 1 and close to the deflection roller 2. Essentially, this device comprises a twisting disk supported for rotation abouted the twisting axis in both directions. The twisting disk is equipped, in well known manner, with holes through which the individual twisting elements are led.

The twisting elements 8 are obtained from supply reels 5 and run off those reels and through the twisting nipple 1. Alternatively, the individual elements may be twisted elements obtained from a proceeding twisting device or may be wires obtained from insulating apparatus i.e., apparatus which places electrical insulation on conductors. In any case there is a continuous supply of the elements 8 to the nipple 1. The elements are led from the nipple 1, through the twisting disk 3, in which they are twisted, and their over the deflection roller 2 as finished unit 9. The unit 9 is then deflected around a roller 6 and wound up on a reel or drum 7. Alternatively, 7 can represent a further twisting apparatus in which the units 9 are twisted into larger units with other units 9 which have been twisted in a parallel apparatus or may represent an extruder for applying a jacket to the twisted unit combined with means for pulling-off and winding the finished cable.

In accordance with the present invention, and in order to twist the elements 8, the twisting device 3 is rotated continuously in one or the other direction. For example, with a constant speed of rotation of the twisting device 3, the twisting elements are twisted behind the twisting device to have a constant length of lay forming the twisted unit 9. Twisting also occurs due to the twisting nipple or twisting point 1. However, since the twisting elements are untwisted in the vicinity of the twisting device 3, the length of lay of the element decreases continuously in the region between the nipple 1 and the twisting device 3. In accordance with the present invention it is important that the twisting exerted on the elements can be distributed over a fairly long section of the twisting material. Thus, the number of revolutions of the twisting device 3 in a given direction is dependent on the length of the section between the nipple 1 and twisting device 3. If the assumption is made, for example, that the length of lay of the twisted material in the region between the nipple 1 and twisting device 3 should, to the greatest extent possible, not be shorter than the final length of lay of the twisted material, the distance between the twisting nipple 1 and twisting device 3 should be chosen to be half as large as the length of a section of constant twist direction of the completely twisted twisting unit. Thus, for example if a section with the same twist direction is to have length of 4 m, then the distance between the twisting nipple 1 and the twisting device 3 should advantageously be 2 m. Such short distances between the twisting nipple 1 and the twisting device 3 are of particular interest where relatively short lengths of lay are to be achieved during the twisting process. Such is the case, for example, when twisting conductors. If, however, larger lengths of lay are permissible during the twisting [as is the case when twisting conductors for power lines or twisting spiral quads form basic bundles] then it is advisable to have a larger distance between the twisting device 3 and the twisting nipple 1.

Figure 2:
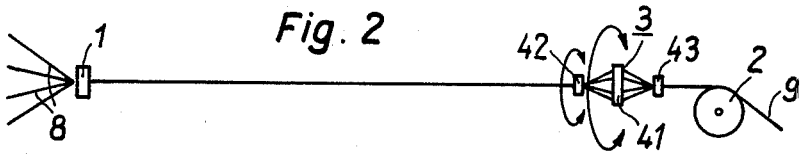

FIG. 2 illustrates another embodiment of the apparatus of the present invention which includes twisting nipples 42 and 43 arranged respectfully in front of and behind the twisting device 3. In this embodiment, the twisting nipple 42 is rigidly coupled to the twisting disk 41 in the twisting device 3. i.e., it rotates with it. By so arranging twisting nipples on both sides of the twisting disk, the untwisting and twisting process of the twisted material in the vicinity of the twisting disk 41 is exactly limited in the locality of the disk.

Figure 3:
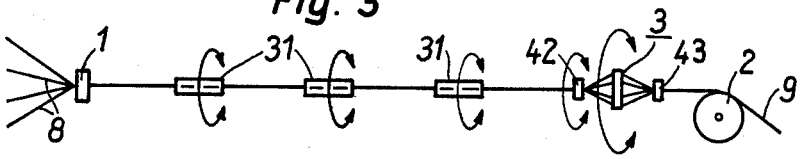

In the twisting apparatus of FIG. 3, which constitutes a further embodiment of the present invention, additional twisting devices 31 are disposed between the nipple 1 and twisting device 3. These are used to develop homogeneous twist in the region between the nipple 1 and twisting device 3. These are devices of the type which grab the material from the outside in the circumferential direction in the manner of a friction clutch. The force is only a light friction force. The direction of rotation of these additional devices 31 is always the same as the direction of rotation of the twisting device 3. The necessary light frictional forces can be obtained through the use of twisting nipples or short sections of tubing either of which will have an inside diameter corresponding approximately to the diameter of the twisted material.

Figure 4:
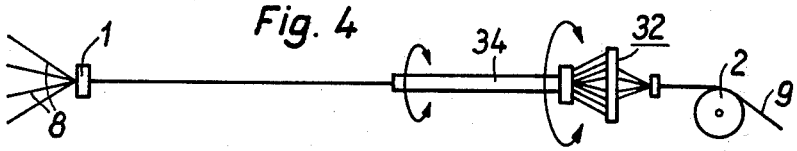

A further embodiment of the present invention is illustrated by FIG. 4. In this embodiment, a guide tube 34 is rigidly coupled to a twisting device 34. Such a guide tube will have an inside diameter essentially the same as the diameter of the material being twisted. Perferably its length is approximately one-third of the distance between the twisting nipple 1 and twisting device 32. By so arranging the guide 2, homogeneous twisting of the twisted material in the region of the torsioning section results, and thereby a minimum of mechanical stress is present in the vicinity of the twisting disk when the twisted material is expanded in basket like fashion for the twisting process.

Figure 5:
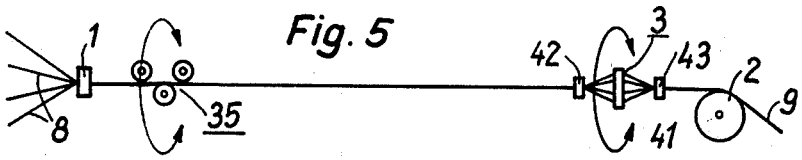

FIG. 5 shows a further embodiment of the apparatus of the present invention. In this arrangement, the twisting device 3 has arranged in front and behind it twisting nipples 42 and 43 respectively. The twisting disk 3 is arranged immediately before the second twisting point at the roller 2. And additional twisting device 34 is disposed near i.e., immediately behind, the twisting nipple 1. This is what is known as a twister or twisting head and it is the type of device which grips the material from the outside with a positive friction force and twists the material in accordance with its speed of rotation.

Figure 6:
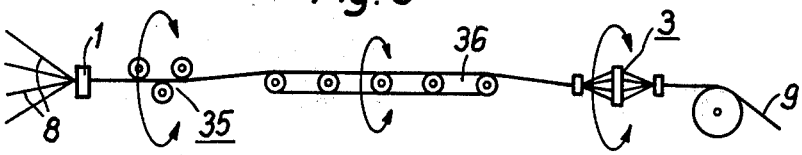
Figure 7:
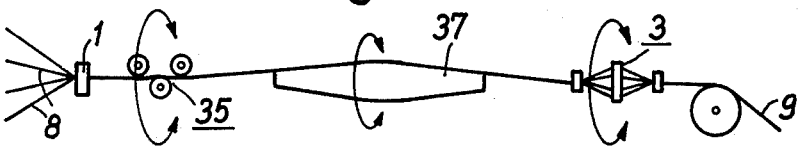

In accordance with the present invention, the twisting head 35 revolves synchronously with the twisting device 3, the speed of rotation of the twisting head arranged to be one-half the speed of rotation of the twisting device 3. With such an arrangement reversal points of the twist direction in the twisted material which runs through the torsioning section are formed in dependence on the direction of rotation of the twisting head 35. In order to avoid untwisting of these reversal points of twist direction in the torsioning section due to the tension forces, guide elements can be used. The manner in which this is accomplished is illustrated by FIGS. 6 and 7. FIG. 6 illustrates a rotating caterpillar belt 36 against which the twisting material rests on one side. FIG. 7 illustrates a slightly elliptical or bulb-shaped bar 37 used a as guide element. Such a device contains a longitudinal slot for guiding the twisted material. Through the use of these guide elements, the material being twisted is deflected slightly from the twisting axis resulting in a frictional contact between the twisted material and the guide element. This frictional contact prevents untwisting of the reversal points of the twist direction as the material runs through the torsioning section.

Figure 8:
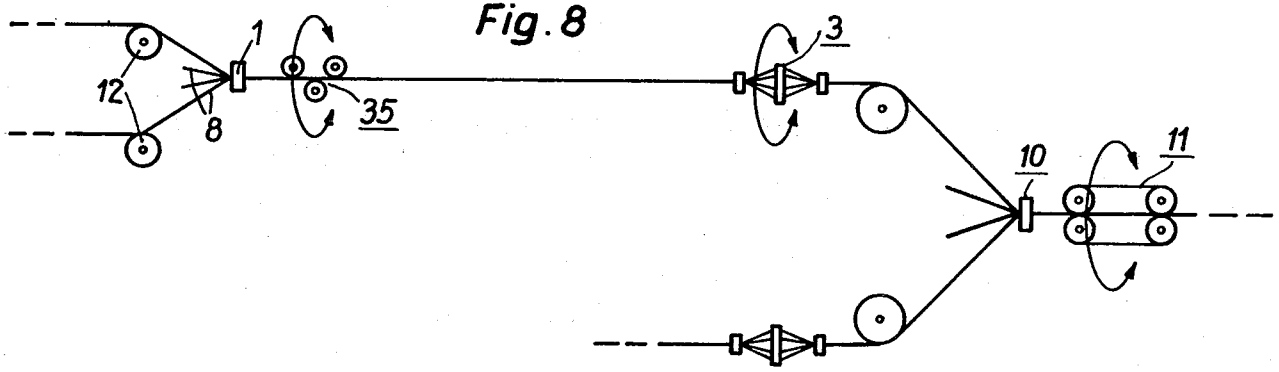

FIG. 8 illustrates the manner in which a plurality of devices such as those shown on the previous figures may be operated parallel. Elements obtained from a previous process are deflected over rollers 12 to the twisting nipple 1 after which twisting is carried out as described in connection with FIG. 5. As indicated on the Figure there are additional units carrying out such twisting. The units 9 so formed are then provided to a twisting nipple 8 and a further frictional type twisting device 11 where these are then twisted into a larger group or bundle.

Figure 9:
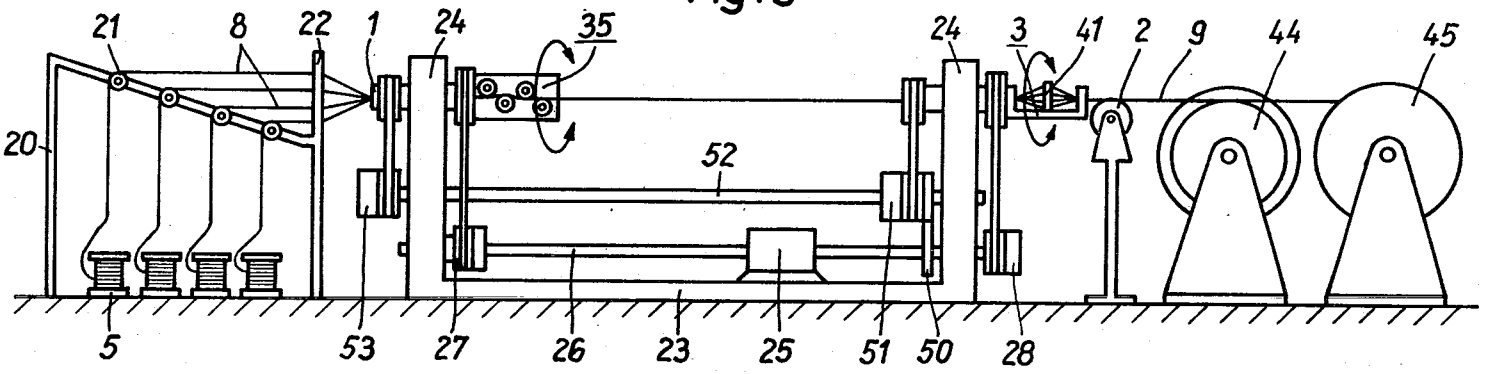
Figure 10:
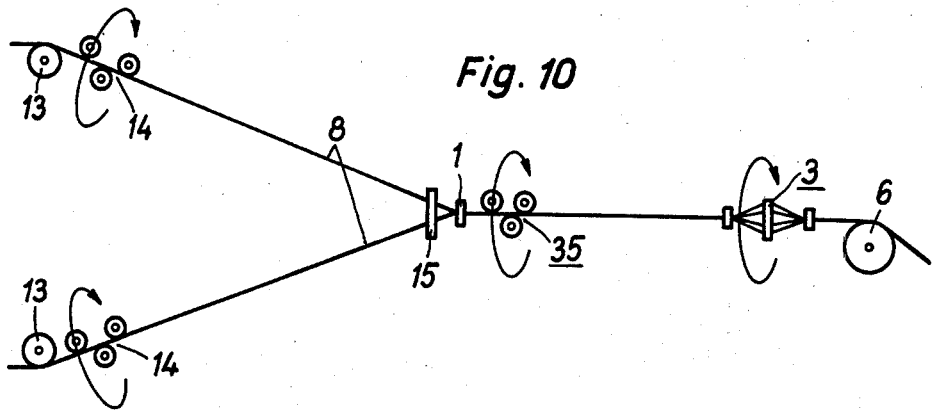
Figure 11:
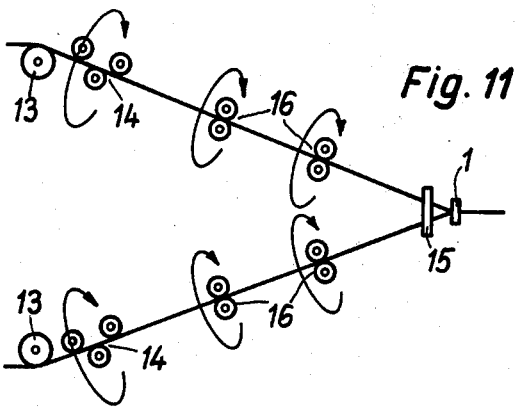
Figure 12:
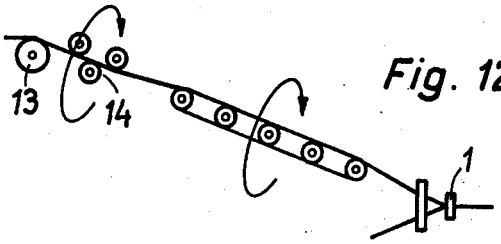
Figure 13:
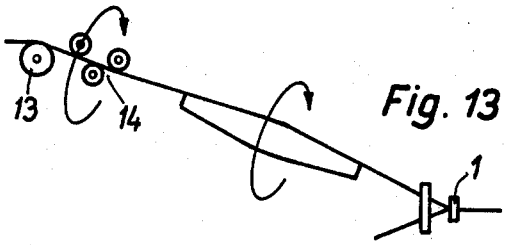

FIG. 9 is a more detailed illustration of a twisting apparatus such as that shown on FIG. 5. In this device, four conductors 8 are to be twisted into a spiral quad 9 in such a manner that they have a twist direction which alternates from section to section. Four stationary conductor supplies 5 are provided resting on the floor below a frame 20 containing deflection rollers 21. The individual conductors are led from the supply reels 5 over the deflection rollers 21 to a sorting plate 22 from which they enter the SZ-twisting apparatus itself. After running through this apparatus, the finished spiral quad leaves the deflection roller 2 around which the quad is looped once and is drawn by a pulley 44, used for pulling-off the finished quad, after which it is wound up on a drum 45.

The SZ-twisting machine includes twisting devices 35 and 3. These two twisting devices are supported for rotation about the twisting axis in a stand having upright members 24 and a base 23. A motor 25 is secured to base 23 to provide for rotation of these devices. Motor 25 has a shaft 26 extending in both directions and supported in suitable bearings in the upright members 24. The shaft 26 is coupled to a transmission 27 at the left hand end and a transmission 28 at the right hand end. These transmissions will typically be pully arrangements equipped with magnetic clutches. A gear 50 couples the shaft to a transmission 51 whose shaft 52 is coupled to a further transmission 53. Each of the units will also have magnetic clutches. Suitable belts couple the pullyes on each of the transmissions 27, 28, 51 and 53 to the respective twisting units 3 and 35. From an examination of the figure, it is evident that by engaging the clutches of the transmission 27 and 28 both twisting units 3 and 35 can be caused rotates in one direction. By opening those clutches and engaging the clutches in the transmissions 51 and 53, which are driven by the gear 50 and on are the shaft 52, rotation in the opposite direction becomes possible. The transmissions i.e., pullyes are arranged to have the proper size and ratios so that the twisting 35 always rotates at half the speed of twisting device 3. The twisting device 3, as illustrated, includes a twisting disk 41 through which the twisted material i.e., the conductors 8, are led. In this device the material is temporarily untwisted in the vicinity of this twisting head.

In the twisting operation, the conductors 8 first enter the twisting nipple 1 and are combined into a strand. The strand is torsioned in the region between the twisting nipple 1 and twisting head 35 arranged immediately therebehind. As the strand passes through the twisting section, the twisting elements remain in this torsioned condition until arriving at the twisting disk 41 of the twisting head 3. There the elements are untwisted and immediately thereafter twisted to get their final twist. In this manner an exact correlation of the twisting elements within the twisted unit with a constant length of lay is achieved by using the disk 41.

The direction of rotation of the twisting heads 35 and 3 is changed at intervals corresponding to time for a cross-sectional element of the twisted material to pass from the twisting nipple 1 to the twisting disk 41. As noted above such change in direction is carried out by alternately engaging clutches of the transmissions 27 and 28 and the clutches of the transmissions 51 and 53 to cause their associated twisting heads to rotate first in one and then the other direction.

Thus, improved apparatus for the twisting of twisting elements into twisted units has been shown. Although specific embodiments have been illustrated and described, it will be obvious to those skilled in the art that various modifications may be made without departing from the spirit of the invention which is intended to be limited solely by the appended claims.

What is claimed is:

1. Apparatus for twisting elements for an electrical cable into a twisted unit having a twist direction which alternates from section to section comprising:

a. supply means for twisted elements;

b. a guide nipple through which all of said twisted elements pass and are formed into a contiguous group defining a first twisting point;

c. means defining a second twisting point, a torsioning section being defined by the two twisting points;

d. means for pulling the twisted unit off and winding it; said twisted elements passing from said supply means first through said guide nipple and from said guide nipple to said means defining a second twisting point;

e. twisting means in the form of a single twisting disk supported for rotation in either direction arranged within the torsioning section closer to said second twisting point that to said first twisting point.

2. Apparatus according to claim 1 and further including a twisting nipple immediately ahead of said twisting means on the side of said first twisting point.

3. Apparatus according to claim 1 and further including twisting nipples immediately next to said twisting means on each side.

4. Apparatus according to claim 3 wherein at least one of said twisting nipples is supported for rotation.

5. Apparatus according to claim 4 wherein said at least one twisting nipple is rigidly coupled to said twisting disk.

6. Apparatus according to claim 1 and further including at least one additional twisting device disposed between said first twisting point and said twisting disk, said additional twisting device being a device which engages the twisting material circumferentially from the outside with a light frictional force, said additionally twisting means being rotated with a direction of rotation the same as that of said twisting disc.

7. Apparatus according to claim 6 wherein said additional twisting device comprises a rotatable twisting nipple.

8. Apparatus according to claim 6 wherein said additional twisting device comprises a rotatable guide tube section.

9. Apparatus according to claim 1 and further includes a guide tube surrounding said twisting elements and rigidly coupled to said twisting disc and extending therefrom in the direction of said first twisting point.

10. Apparatus according to claim 8 wherein the length of of said guide tube is approximately between 1/3 and 1/2 the distance between said first twisting point and said twisting disc.

11. Apparatus according to claim 1 wherein said twisting disc is arranged immediately ahead of said second twisting point and further including an additional twisting device arranged immediately behind said first twisting point, said additional twisting device being a device of the type which engages the twisting elements from the outside in a force transmitting manner.

12. Apparatus according to claim 10 wherein the distance between said twisting device and said additional twisting device is between 10 and 50 times the length of lay produced by said twisting apparatus.

13. Apparatus according to claim 1 and further including means for rotating said twisting means, said means adapted to change the direction of rotation thereof only after at least three complete revolutions in one direction.

14. A method for twisting elements for electrical cables to form a twisted unit having a twist direction which alternates from section to section comprising the steps of:

a. tensioning the twisting elements between a first and second twisting point with said twisting elements contiguous to each other at both said first and second twisting points;

b. disposing a twisting device comprising a single twisting disc near said second twisting point;

c. running said twisting elements through the section defined between said first and second twisting points from said first to said second twisting point in a stretched condition;

d. rotating said twisting disc with a direction of rotation which alternates; and e. changing the direction of rotation of said twisting disc only after at least three complete revolutions in one direction.

15. The method of claim 14 wherein the direction of rotation of said twisting disc is changed at intervals corresponding to twice the time for a crosssectional element of the twisted materal to pass from said first twisting point to said twisting disc.

16. The method according to claim 14 and further including the steps of:

a. providing at least one second twisting device in the section between said twisting points behind said first twisting point; and b. rotating said second twisting device with the same direction of rotation as said twisting disc but with a speed of rotation which is directly proportional to the speed of rotation of said disc but inversely proportional to the distance of said second twisting device from said twisting disc.

17. The method according to claim 14 and further including the steps of:

a. providing an additional twisting device immediately behind said first twisting point;

b. rotating said twisting disc with a constant speed of rotation and alternating direction of rotation;

c. rotating said additional twisting device with the same direction of rotation of said twisting device but at half the speed of rotation of said twisting device; and d. changing the direction of rotation of said twisting device and said additional twisting device at intervals corresponding to the passage time of the cross section element of the twisting elements from the first twisting point to said twisting disc.

* * * * *